United States Patent [19]

Fagerlund

[11] Patent Number: 4,601,787

[45] Date of Patent: Jul. 22, 1986

[54] METHOD OF BRINGING A DIGESTER UP TO COOKING TEMPERATURE

[75] Inventor: Bertil K. E. Fagerlund, Järfälla, Sweden

[73] Assignee: Beloit Corporation, Beloit, Wis.

[21] Appl. No.: 599,142

[22] Filed: Apr. 11, 1984

[51] Int. Cl.[4] ..... D21C 7/10; D21C 7/12; D21C 7/14

[52] U.S. Cl. ..... 162/45; 162/61; 162/62; 162/249

[58] Field of Search ..... 162/47, 61, 62, 249, 162/250, 241, 41, 43, 44, 45

[56] References Cited

U.S. PATENT DOCUMENTS 2,671,727 3/1954 Westcott et al. ..... 162/62

2,882,148 4/1959 Rosenblad ..... 162/61

*Primary Examiner*—Steve Alvo

*Attorney, Agent, or Firm*—Hill, Van Santen, Steadman & Simpson

[57] ABSTRACT

A method for bringing a digester up to cooking temperature efficiently and rapidly wherein wood chips are packed in the digester, covered with a hot spent liquor, and then a hot liquor displacing liquid is used to displace the hot spent liquor from the digester and send it to an alkali adjustment zone in an accumulator. After the hot spent liquor has been displaced, the hot liquor displacing liquid is passed through the digester and into a lower portion of the alkali adjustment zone. Hot liquor is constantly passed from a constant volume heating zone into the alkali adjustment zone by overflow or otherwise. Hot liquor at the cooking temperature is passed from the top of the heating zone into the bottom of the digester and relatively cool liquor after passage through the digester passes from the top of the digester to the bottom of the heating zone. This type of circulation is continued until liquor leaving the top of the digester is at the cooking temperature whereupon the circulation is terminated and the heat content of the liquor in the heating section is increased by passage through a separate heat exchanger.

7 Claims, 2 Drawing Figures

METHOD OF BRINGING A DIGESTER UP TO COOKING TEMPERATURE

BACKGROUND OF THE INVENTION

1. Field of the Invention

This invention is in the field of cooking of wood chips in a digester in the manufacture of pulp for papermaking and is specifically involved with a method of circulating liquors used in t:e process to bring the digester up to cooking temperature efficiently and rapidly.

2. Description of the Prior Art

In conventional cooking of wood chips in a digester, the temperature is raised to cooking temperature either by using indirect heating of the cooking liquor with a circulation system including a heat exchanger, or by direct heating which involves injecting steam directly into the digester. Both of these operations are time consuming, usually taking from 45 to 90 minutes. The indirect system is more efficient from an energy standpoint than the direct injection system.

In various cooking installations of the batch type, there is a significant variation in the usage of steam from steam generating plants depending upon which portion of the cycle is being carried out. This is an inefficient use of steam and significantly adds to the cost of the overall operation.

A prior art disclosure having some similarity with the subject matter of the present invention will be found in Rosenblad U.S. Pat. No. 2,882,148. In accordance with this disclosure, a digester is filled with a liquid of considerably lower temperature than the cooking temperature, the liquid being pumped into the digester so that air or other gas contained in the digester during the operation will be displaced or forced out of the digester by the liquid. This so-called "penetration liquid" can be a cooking liquor of full or less than full strength. The penetration liquid which is pumped in is then rapidly displaced through an outlet from the digester by means of the hot cooking liquor which is pumped into the digester at the cooking temperature. By throttling the outlet pressure in the digester, gases dissolved in the hot cooking liquor remain dissolved therein and thus reduce the evaporation of the hot cooking liquor.

SUMMARY OF THE INVENTION

The present invention provides a method of bringing a digester up to cooking temperature efficiently and rapidly. Basically, the method involves packing wood chips into the digester, and covering them with a hot spent liquor. This liquor is displaced with a hot liquor displacing liquid from an alkali adjustment zone located in an accumulator. After the hot spent liquor has been displaced, the displacing liquid is passed through the digester and is directed to the lower portion of the alkali adjustment zone. Hot liquor from a constant volume heating zone which may be located in a separate portion of the accumulator is passed into the alkali adjustment zone, usually as an overflow. The liquor in the heating zone is maintained at a constant volume. Hot liquor at the cooking temperature is passed from the top of the heating zone into the bottom of the digester and a circulation commences in which a relatively cooler liquid after passage through the digester exits from the top of the digester and is directed to the bottom of the heating zone. This type of circulation is continued until the liquor leaving the top of the digester is at the cooking temperature. Then the circulation is terminated and the heat content of the heating section is restored by circulating the liquor therein through a heat exchanger to raise the temperature of the liquor.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
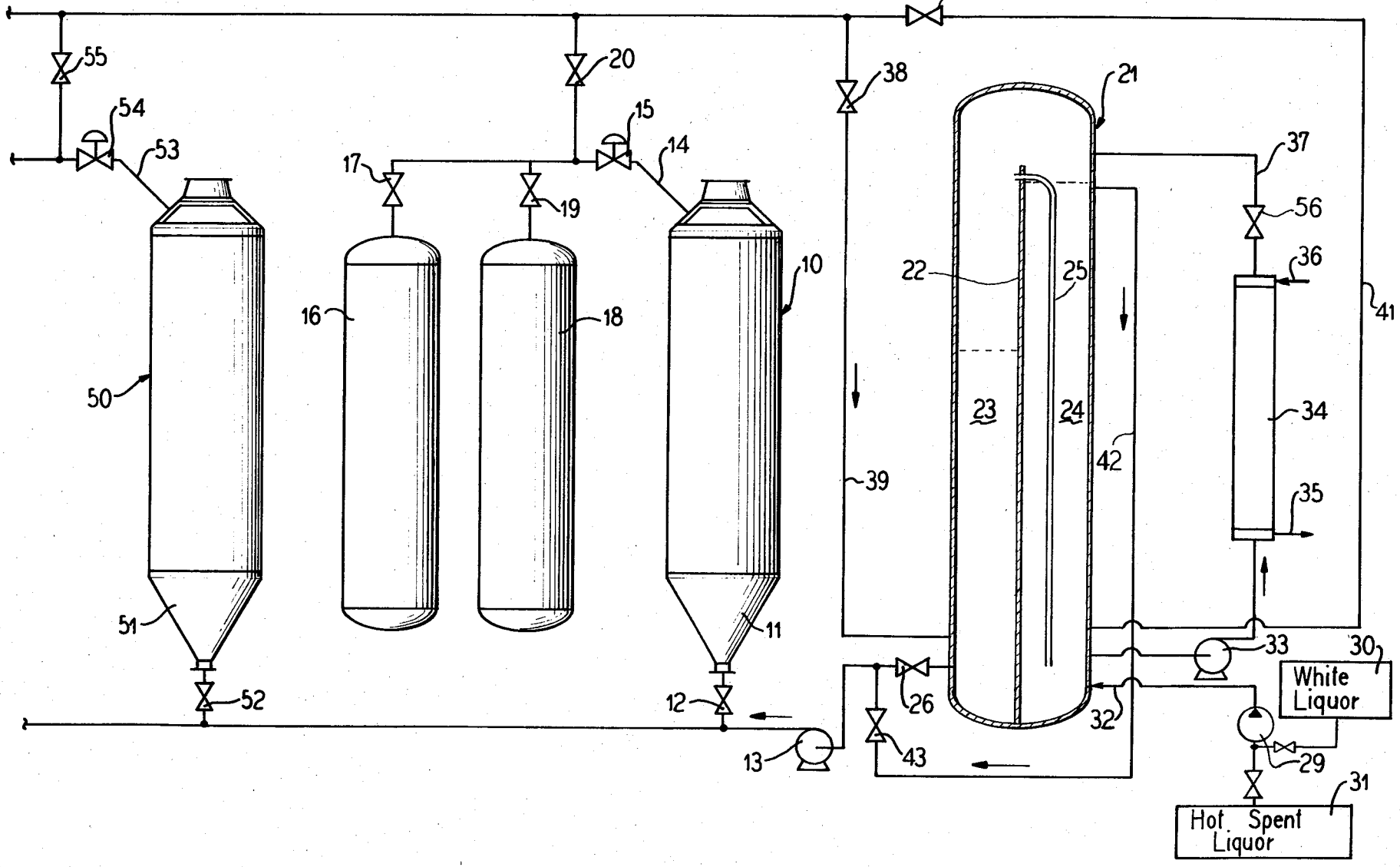
FIG. 1 is a somewhat schematic representation of a batch digester system embodying the improvements of the present invention.

In FIG. 1, reference numeral 10 has been applied generally to a digester of the conventional type for cooking wood chips. The digester 10 has a truncated bottom section 11. An inlet valve 12 controls introduction of the various liquors into the digester 10, the liquors being pumped therein through a pump 13.

Liquor is discharged from the digester 10 through an exit line 14 controlled by a valve 15. The liquor passes through a screen (not shown) which retains chips and pulp. The liquor can be passed to a low temperature accumulator 16 under the control of a valve 17, or to a high temperature accumulator 18 under the control of a valve 19. Alternatively, the liquor from the digester can be pumped through a valve 20 in a liquor circulation path which will be described subsequently.

One of the features of the present invention resides in a novel type of white liquor accumulator which has been illustrated at reference numeral 21 of the drawings. A centrally disposed baffle 22 divides the interior of the accumulator 21 into an alkali adjustment section 23 and a constant volume heating section 24. In the form of the invention shown in FIG. 1, communication from the heating section 24 to the alkali adjustment section 23 is carried out by means of an overflow pipe 25 having one end near the bottom of the liquor contained in the heating section 24 and its upper end received through an opening in the baffle 22 so that the liquor discharges into the alkali adjustment zone 23.

The alkali adjustment zone 23 near its lower end is provided with a discharge valve 26 through which liquor can be drawn by the operation of the pump 13 and introduced into the digester 10.

The liquid level in the heating zone 24 is kept constant by the provision of the overflow pipe 25. A pump 29 is fed selectively from a source of white liquor 30 or a source of hot spent liquor 31 derived from the high temperature accumulator 18. This liquor is pumped by the pump 29 through a line 32 into the lower end of the heating zone 24.

An additional pump 33 is used to circulate liquor in the heating zone 24 through a heat exchanger 34, the latter having a steam inlet 36 and a steam condensate outlet 35 for circulating steam therethrough. Liquor passing through the heat exchanger 34 is introduced into the top of the heating zone 24 through a line 37.

Liquor discharged through the valve 20 of the digester system can proceed selectively through a valve 38 and a line 39 into the bottom portion of the alkali adjustment zone 23 or it may proceed through a valve 40 in a circulatory path via line 41 into the bottom of the heating zone 24.

Hot liquor from the constant volume heating zone 24 is circulated by means of a line 42 through a valve 43 into the inlet end of the pump 13 for introduction into the digester 10.

The system of the present invention is intended to operate with several digesters, each operating batchwise. Accordingly, there is shown a second digester 50 having a truncated bottom section 51 and a valve 52 through which the various liquors can be introduced into the digester by the operation of the pump 13. A discharge line 53 under the control of a valve 54 and a valve 55 is provided to recirculate the liquor from the digester 50 into the accumulators 16 and 18, or into the white liquor accumulator 21.

Figure 2:
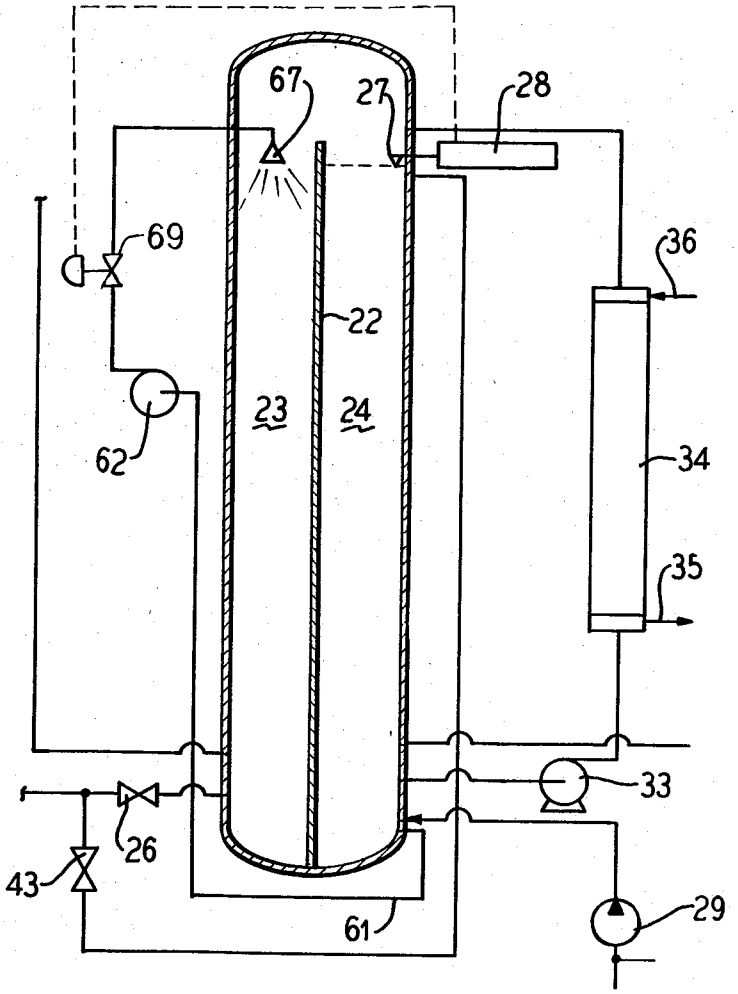
FIG. 2 is a fragmentary view of another form of the invention in which communication between the heating zone and the alkali adjustment zone is by means of a spray device.

The embodiment shown in FIG. 2 is in many respects similar to that shown in FIG. 1 and corresponding reference numerals have been used where appropriate. The difference comes in the manner in which liquor is circulated from the heating zone 24 to the alkali adjustment zone 23. In the form of the invention illustrated in FIG. 2, the overflow pipe 25 of FIG. 1 is replaced by a circulating system including a line 61 which withdraws liquor from the constant volume heating zone 24 and transfers it by means of a pump 62 into the alkali adjustment zone 23 by means of a spray head 63. The liquid level of the heating zone 24 is maintained at constant value by the provision of a sensor 27 which operates in conjunction with a constant level device 28. This device controls the operation of a valve 69 in the discharge line of the pump 62.

Figure 3:
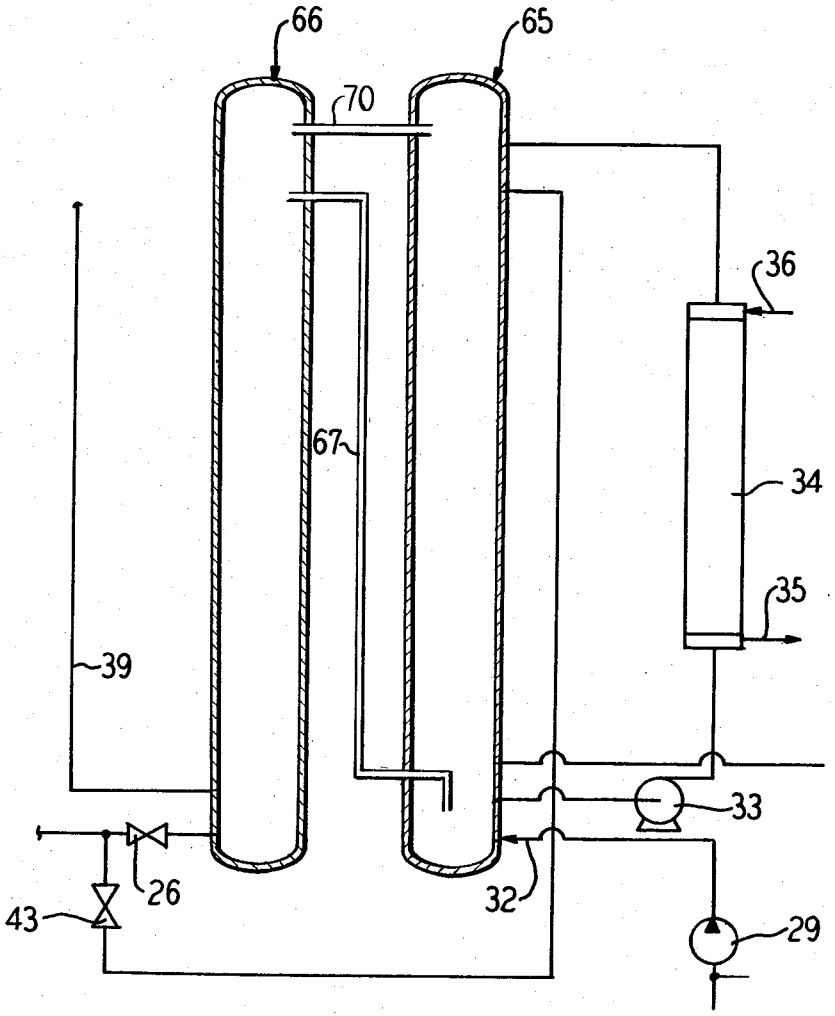
FIG. 3 is a fragmentary view illustrating a modified form of the invention in which the accumulator is composed of two tanks.

The embodiment shown in FIG. 3 is also similar in many respects to that shown in FIG. 1 and corresponding numbers have accordingly been used for the same elements. Instead of a baffled accumulator structure, however, the form of the invention of FIG. 3 uses a pair of accumulators 65 and 66, the accumulator 65 providing the heating zone and the accumulator 66 providing the alkali adjustment zone. Communication between the two accumulators is accomplished by providing a pipe 67 which transfers liquor from the base of the accumulator 65 to a position near the top of the accumulator 66. In order to eliminate pressure differentials between the two vessels 65 and 66 a pipe line 70 connecting the tops of these vessels is provided.

The structural modification of FIGS. 2 and 3 are merely variants which can be used in different installations, but the method of operation is the same in all three Figures, and will be explained in conjunction with FIG. 1.

The first step in the process consists in packing the digester 10 with wood chips to a predetermined level and then introducing a hot spent liquor into the digester to precondition the chips for the subsequent cook, without actually cooking them. After a suitable period of time, pump 13 is started with valve 26 being opened and a hot liquor displacing liquid is introduced into the digester through the valve 12 to displace the hot spent liquor which was used to precondition the wood chips. The displaced liquor goes up through the digester and is passed to either the low temperature accumulator 16 or the high temperature accumulator 18 depending upon its temperature. At this time, the level in the alkali adjustment section 23 is lowered despite the fact that liquor is being fed therein from the heating zone 24 at a constant volume by means of the overflow from the heating zone of the accumulator tank 21.

After the original treating liquor is displaced into the low temperature and high temperature accumulators 16 and 18, respectively, the accumulators are shut off by closing valves 17 and 19 and the displacing liquor proceeds through the digester and into the lower portion of the alkali adjustment section 23 by means of opening valves 20 and 38. By means of this circulation through the digester and the alkali adjustment section 23, any alkali gradients in the liquor are leveled out.

The succeeding step involves closing valves 26 and 38, thereby terminating the circulation and permitting the liquor to impregnate the chips in the digester 10 for a suitably long period of time. After the suitable impregnation period, valves 40 and 43 are opened and liquor at the cooking temperature and at essentially the same alkali content as in the digester is pumped into the bottom of the digester through valve 12 and displaces the digester liquid out through the top of the digester through the line 14. The displaced liquor returns to the bottom of the heating zone through the valve 40 and the line 41.

During this circulation, the interface between the cooler liquid and the liquor at cooking temperature moves upward in the heating zone 24. When the liquor coming out of the top of the digester is at the cooking temperature, the circulation stops and valves 40 and 43 are closed.

While waiting for the next digester, such as digester 50 to be heated, the liquor in the heating zone 24 has its heat content replenished by uninterrupted circulation of the liquor through heat exchanger 34 by pump 33, which moves the interface between the cooler and the hot liquids downward, thus building up the heating potential for the next cooking cycle. This circulation goes on continuously during all the sequences, thus allowing for a substantially constant steam flow to the heat exchanger. The temperature in the heat exchanger line 37 is determined by the desired cooking temperature. The liquor flow through the heat exchanger is controlled by a valve 56 in line 37 to move the interface between cooler liquor and hot liquor at an adequate rate to charge the heating zone between heating cycles.

The amount of white liquor introduced from the supply 30 depends on the production rate, and the alkali level desired. The flow of hot spent liquor from the supply 18 to the accumulator tank 21 is controlled by the requirement of keeping the level in the alkali adjustment section within a given range.

The system of the present invention makes it possible to control alkali concentration in the digesters using one circulation pump which eliminates the need to provide separate circulation pumps on each digester. The system described herein includes the possibility of heating the digesters to cooking temperature by displacement from one central location, utilizing one heat exchanger operating at a constant steam flow. This eliminates the need for separate heat exchangers on each digester, and offers an opportunity for mills which utilize direct steam for cooking purposes to convert into indirect heating without having to install circulation in heating systems for each of the digesters. This has an impact on the evaporator capacity required, and the costs of feedwater.

In accordance with the present invention, the digesters can be brought up to temperature very quickly without providing problems due to extreme steam peaks. The relatively constant usage of steam provides a highly efficient and more economical usage of steam energy.

It should be understood that various modifications can be made to the described embodiments without departing from the scope of the present invention.

I claim as my invention:

1. The method of bringing a digester up to cooking temperature efficiently and rapidly which comprises the following steps:

(1) packing wood chips into said digester, (2) covering said chips with a hot spent liquor, (3) displacing said hot spent liquor with a hot liquor displacing liquid from an alkali adjustment zone, (4) after said hot spent liquor has been displaced, passing said hot liquor displacing liquid into a lower portion of said alkali adjustment zone, (5) continuously circulating hot liquor from a constant volume heating zone into said alkali adjustment zone, (6) continuously circulating hot liquor at the cooking temperature from the top of said heating zone into the bottom of said digester, (7) continusouly circulating relatively cooler liquid after passage through said digester in step (6) from the top of said digester to the bottom of said heating zone, (8) continuing circulation of said liquor as specified in steps (6) and (7) until the liquor leaving the top of said digester is at the cooking temperature, (9) terminating the circulation as specified in step (8), and

(10) circulating the liquor in said heating section through a heat exchanger to raise the temperature of the liquor therein.

2. A method according to claim 1 in which:

the liquor introduced into said heating section is a mixture of white liquor and a hot spent liquor.

3. A method according to claim 1 in which:

said alkali adjustment zone and said heating zone are located in the same vessel.

4. A method according to claim 1 in which:

said alkali adjustment zone and said heating zone are located in separate vessels.

5. A method according to claim 1 wherein the displaced hot spent liquor of step (3) is passed to at least one accumulator.

6. A method according to claim 1 in which:

said hot liquor in step (5) is passed into said alkali adjustment zone by overflow from said constant volume heating zone into said alkali adjustment zone.

7. A method according to claim 1 in which:

said hot liquor from said constant volume heating zone is sprayed into said adjustment zone.

* * * * *